US006832557B2

(12) United States Patent
Torsten

(10) Patent No.: US 6,832,557 B2
(45) Date of Patent: Dec. 21, 2004

(54) REUSABLE GRENADE CARTRIDGE

(75) Inventor: Werner Torsten, Bälinge (SE)

(73) Assignee: Comtri Teknik AB, Balinge (SE)

( * ) Notice: Subject to any disclaimer, the term of this patent is extended or adjusted under 35 U.S.C. 154(b) by 0 days.

(21) Appl. No.: 10/258,483

(22) PCT Filed: Apr. 25, 2001

(86) PCT No.: PCT/SE01/00879

§ 371 (c)(1),
(2), (4) Date: Jan. 27, 2003

(87) PCT Pub. No.: WO01/81854

PCT Pub. Date: Nov. 1, 2001

(65) Prior Publication Data

US 2003/0136293 A1 Jul. 24, 2003

(30) Foreign Application Priority Data

Apr. 27, 2000 (SE) ..... 0001588

(51) Int. Cl.[7] ..... F42B 10/00
(52) U.S. Cl. ..... 102/439
(58) Field of Search ..... 102/439, 447, 102/469, 529, 430, 444

(56) References Cited

U.S. PATENT DOCUMENTS

| | | | | | |
|---|---|---|---|---|---|
| 539,327 | A | * | 5/1895 | Aikin | 102/447 |
| 1,902,771 | A | * | 3/1933 | Gaidos | 102/446 |
| 3,805,702 | A | * | 4/1974 | Voss et al. | 102/439 |
| 3,983,817 | A | * | 10/1976 | Tucker | 102/513 |
| 4,008,665 | A | * | 2/1977 | Gawlick et al. | 102/444 |
| 4,197,801 | A | * | 4/1980 | LaFever et al. | 102/433 |
| H114 | H | * | 8/1986 | Quintaville | 102/513 |
| 4,892,038 | A | * | 1/1990 | Lubbers | 102/439 |
| 4,938,146 | A | * | 7/1990 | Gunther et al. | 102/439 |
| 4,947,752 | A | * | 8/1990 | Richert | 102/430 |
| 5,086,703 | A | * | 2/1992 | Klein | 102/439 |
| 5,259,310 | A | | 11/1993 | Dravecky et al. | |
| 5,259,319 | A | * | 11/1993 | Dravecky et al. | 102/447 |
| 5,402,729 | A | * | 4/1995 | Richert | 102/439 |
| 5,563,365 | A | * | 10/1996 | Dineen et al. | 102/431 |
| 5,834,681 | A | * | 11/1998 | DuBay | 102/430 |
| 5,936,189 | A | * | 8/1999 | Lubbers | 102/439 |
| 5,962,805 | A | * | 10/1999 | Saxby | 102/440 |
| 6,041,712 | A | * | 3/2000 | Lyon | 102/439 |

FOREIGN PATENT DOCUMENTS

GB 2220467 A 1/1990

* cited by examiner

*Primary Examiner*—Michael J. Carone
*Assistant Examiner*—Jordan Lofdahl
(74) *Attorney, Agent, or Firm*—Young & Thompson

(57) ABSTRACT

Grenade cartridge adapted to be fired from a firing tube, comprising a projectile, a cartridge and a propellant with primer. The grenade cartridge (1) is rechargeable by having a dividable, two-part cartridge such that a cartridge front portion (3), as seen in the firing direction, is tube shaped and in a first end thereof formed to receive the projectile (2) whereas the other end is formed to be detachably connected with a cartridge rear portion (4), and a separate propellant cartridge (9) with primer is axially supported in opposite directions by the two cartridge portions being mutually connected.

8 Claims, 5 Drawing Sheets

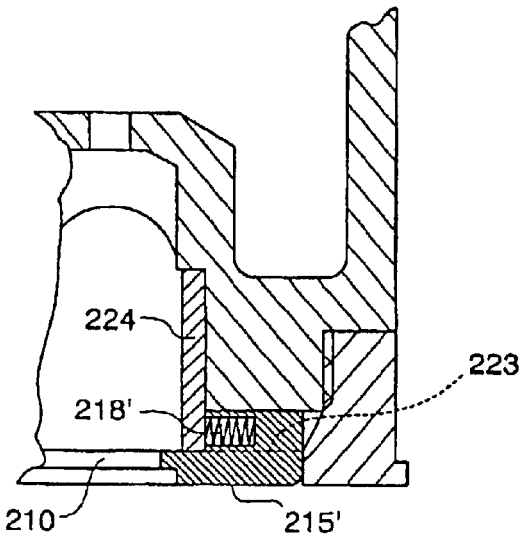
Fig. 4
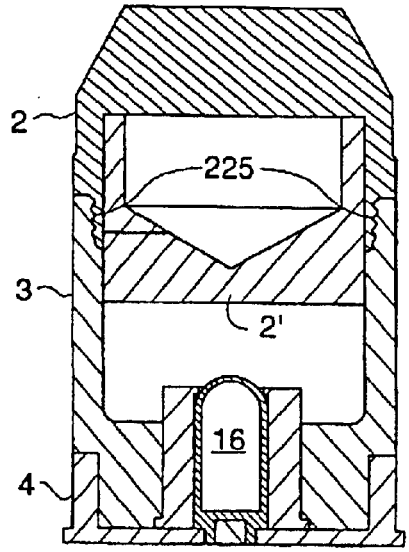
Fig. 5
Fig. 6
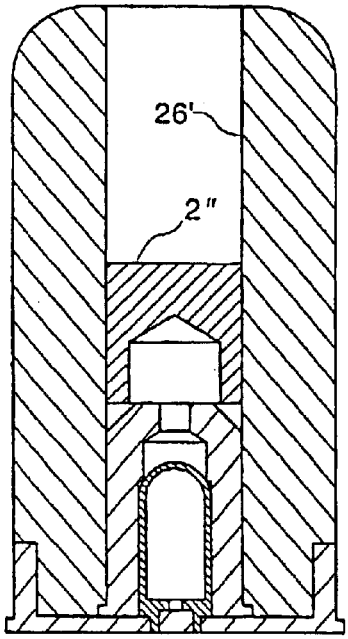
Fig. 7
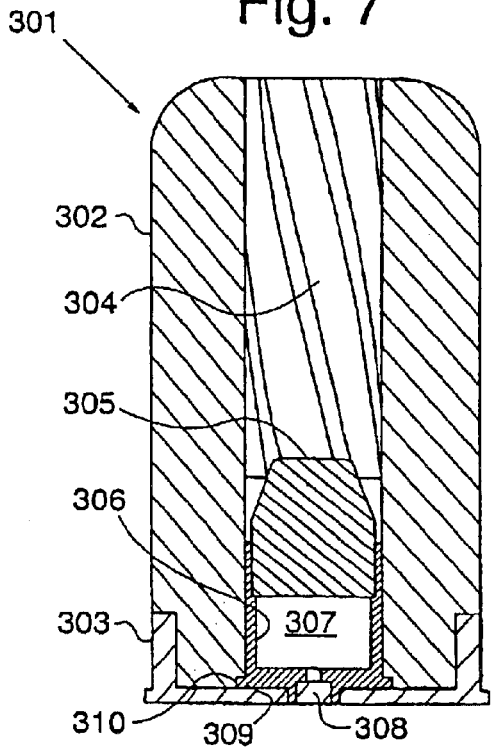

REUSABLE GRENADE CARTRIDGE

This application is the national phase under 35 U.S.C. § 371 of PCT International Application No. PCT/SE01/00879 which has an International filing date of Apr. 25, 2001, which designated the United States of America.

TECHNICAL FIELD OF INVENTION

The present invention relates to a grenade cartridge adapted to be fired from a firing tube, and more specifically the invention relates to a reusable cartridge designed to be reloaded for firing different kinds of projectiles, such as explosive shells and practice ammunition.

The grenade cartridge as herein referred to is conceived primarily to be fired from a hand held firing tube having a firing mechanism. As an alternative, firing may be done from a detachable firing tube that is supported on a small caliber rifle. The cartridge of this invention is however not exclusively used with firing tubes of this kind, but may be adapted and used for firing also from firing tubes of other larger or smaller caliber and from weapons with automatic reloading capacity.

An explosive grenade is a projectile of considerable weight, typically having a caliber of 40 mm, and would generate a powerful recoil at high firing velocities. For that reason, the grenade cartridge often is structured to ensure uniform gas pressures and muzzle velocities also at lower firing velocities. Through these measures, firing of that comparatively heavy projectile may be done at a reduced recoil effect. Typically, the cartridges are formed to have a first chamber or high-pressure chamber, from which the explosive gases reach a second chamber or low-pressure chamber. The structure as such is known as a high-/low pressure system.

A problem connected with training practice for this type of hand held grenade weapons is the high financial cost for the training ammunition. The comparatively low firing velocity drives the projectile into a typical ballistic trajectory, which is characterized by a slight side drift caused from the rotation about the longitudinal axis of the projectile. Evidently, there is a desire to provide a training ammunition that performs closely to the ballistic characteristics of the sharp grenade in order to properly prepare the personnel for their tasks. Therefore, the training ammunition should have a weight and firing properties that correspond with those of the sharp grenade. Shooting practice with disposable grenade cartridges however leads to considerable costs caused by the structural measures taken in the sharp grenade cartridge.

A conventional alternative for training with full caliber ammunition involves an insert barrel that is inserted in the bore of the weapon and adapted for firing 9 mm tracking ammunition, e.g. Naturally, a bullet like that would substantially depart from the weight, flight properties and recoil of the sharp grenade. For that reason, this alternative is often considered not to offer sufficient training on the weapon. Accordingly there is a desire for a serviceable and reusable training grenade cartridge for shooting practice on this kind of grenade weapons.

In a reusable grenade cartridge adapting the principle of a high-/low pressure system, a separate propellant cartridge is inserted into a cartridge chamber of the high-pressure chamber, through an opening in the end plane of the grenade cartridge. A problem connected therewith is the reactive force that tends to separate the propellant cartridge from the grenade by pressing the propellant cartridge out of the cartridge chamber.

In a reusable grenade cartridge adapting the principle of an insert barrel for shooting practice, a separate cartridge with projectile is inserted in a cartridge chamber that opens in the end plane of the grenade cartridge. A problem connected with this solution is the resistance from the rifled bore on the accelerated projectile that tends to pull the grenade cartridge in the firing direction.

Above said drawbacks lead to the risks of deformation forces generated to act between the grenade cartridge and the after most rim of the firing tube, against which the cartridge is supported by means of an outwardly projecting, radial flange.

SUMMARY OF THE INVENTION

The object of the present invention is to provide a reusable grenade cartridge wherein the above stated problems and drawbacks are removed.

Another object is to provide a shooting practice ammunition having similar characteristics as that of an explosive grenade cartridge, and at a substantially lower expense per fired round due to the reloading capacity and repetitive use of the cartridge.

These objects are met in a grenade cartridge as defined by the characterizing part of claim 1. Advantageous embodiments of the invention are defined in the subclaims.

Briefly, the invention suggests a rechargeable grenade cartridge adapted to be fired from a firing tube. The grenade cartridge comprises a projectile, a cartridge and a propellant cartridge with primer. In a preferred embodiment the grenade cartridge is a two-part element, a front portion of which is tube shaped and formed in a first end to accommodate the projectile in the firing direction. A second end of the front portion of the cartridge is releasably retained in assembled relation with a rear portion of the two-part cartridge, and a separate and exchangeable propellant or propellant cartridge is axially and radially supported by the front and rear portions of the cartridge when assembled.

In another preferred embodiment the rear portion of the cartridge forms an end plane and the front portion comprises a high-pressure chamber axially extending in the center of the front cartridge portion, the high-pressure chamber radially enclosing the propellant cartridge in the assembled relation of the two cartridge portions. The propellant cartridge is axially supported between a front end-wall of the high-pressure chamber and the end plane such that the propellant cartridge protrudes, with a radially undercut portion thereof, through a central opening in the end plane.

In an alternative embodiment the end plane of the grenade cartridge is formed to support a firing pin for a separate propellant cartridge arranged to be inserted in a cartridge chamber, formed in the high-pressure chamber.

In yet another embodiment, the rear cartridge portion is ring-shaped, and the front cartridge portion projects with an end-plane thereof through a central opening of the annular rear cartridge portion. A separate propellant cartridge is receivable in a cartridge chamber such as to extend in level with the end-plane, and heels are supported in the end-plane of the front portion for a spring biased engagement with an extractor flange that is formed on the propellant cartridge.

A common feature of these and other embodiments is that reactive forces, generated upon firing and acting between the propellant cartridge and the grenade cartridge or the high-pressure chamber, are completely absorbed by the grenade cartridge. The reactive force is thus prevented from generating a separation of the propellant cartridge from the grenade cartridge. This way, the reactive force is directed towards the shock-absorbing bottom of the firing mechanism, such that deforming forces that would otherwise appear between the grenade cartridge and the firing tube may be successfully prevented.

BRIEF DESCRIPTION OF THE DRAWINGS

The invention is more closely described below with reference to the attached drawings, wherein embodiments of the invention are diagrammatically shown. In the drawings:

FIG. 2 is a longitudinal section showing a second embodiment;

DETAILED DESCRIPTION OF EMBODIMENTS

Figure 1:
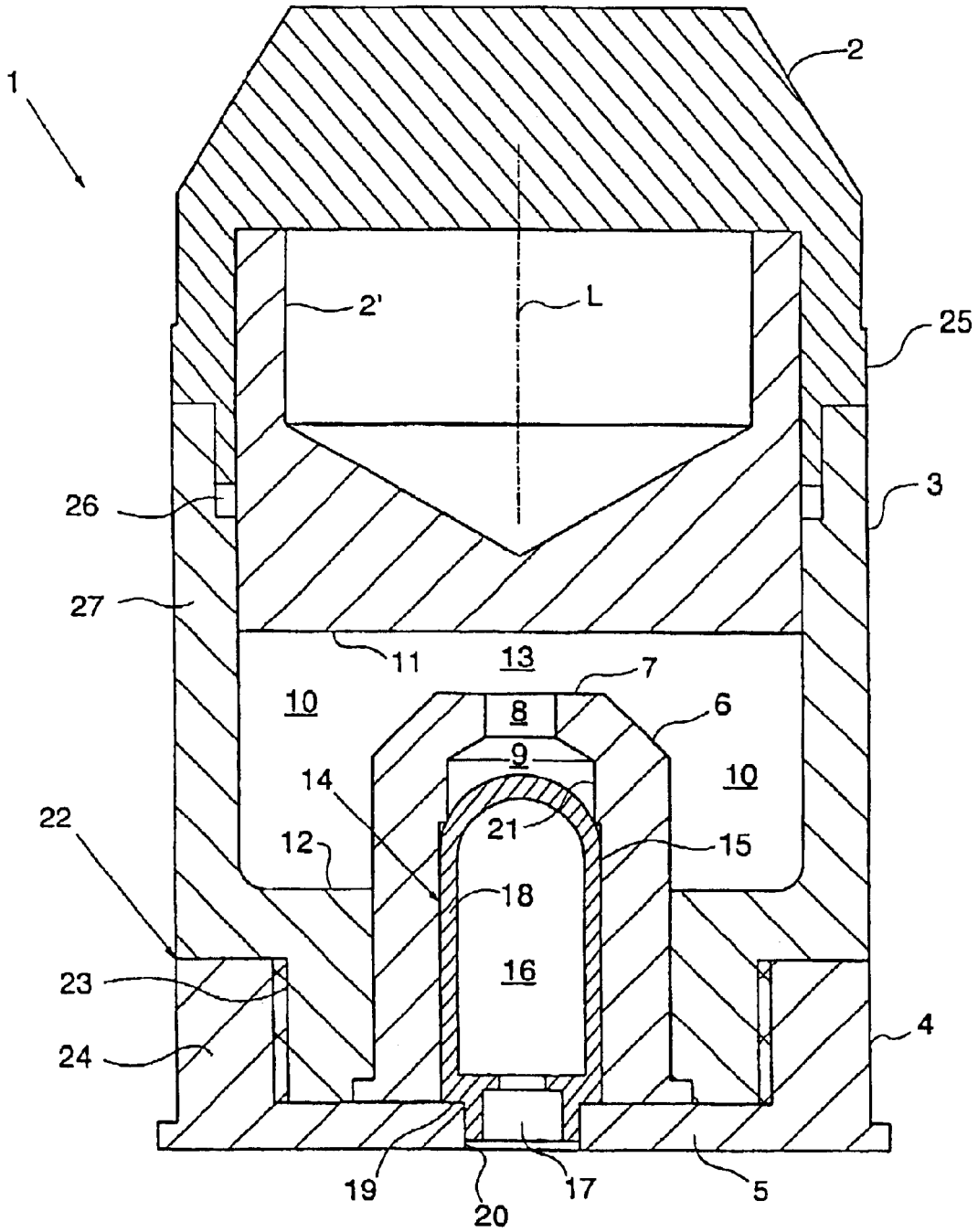
FIG. 1 is a longitudinal section showing a first embodiment of the reusable grenade cartridge.
Figure 1:
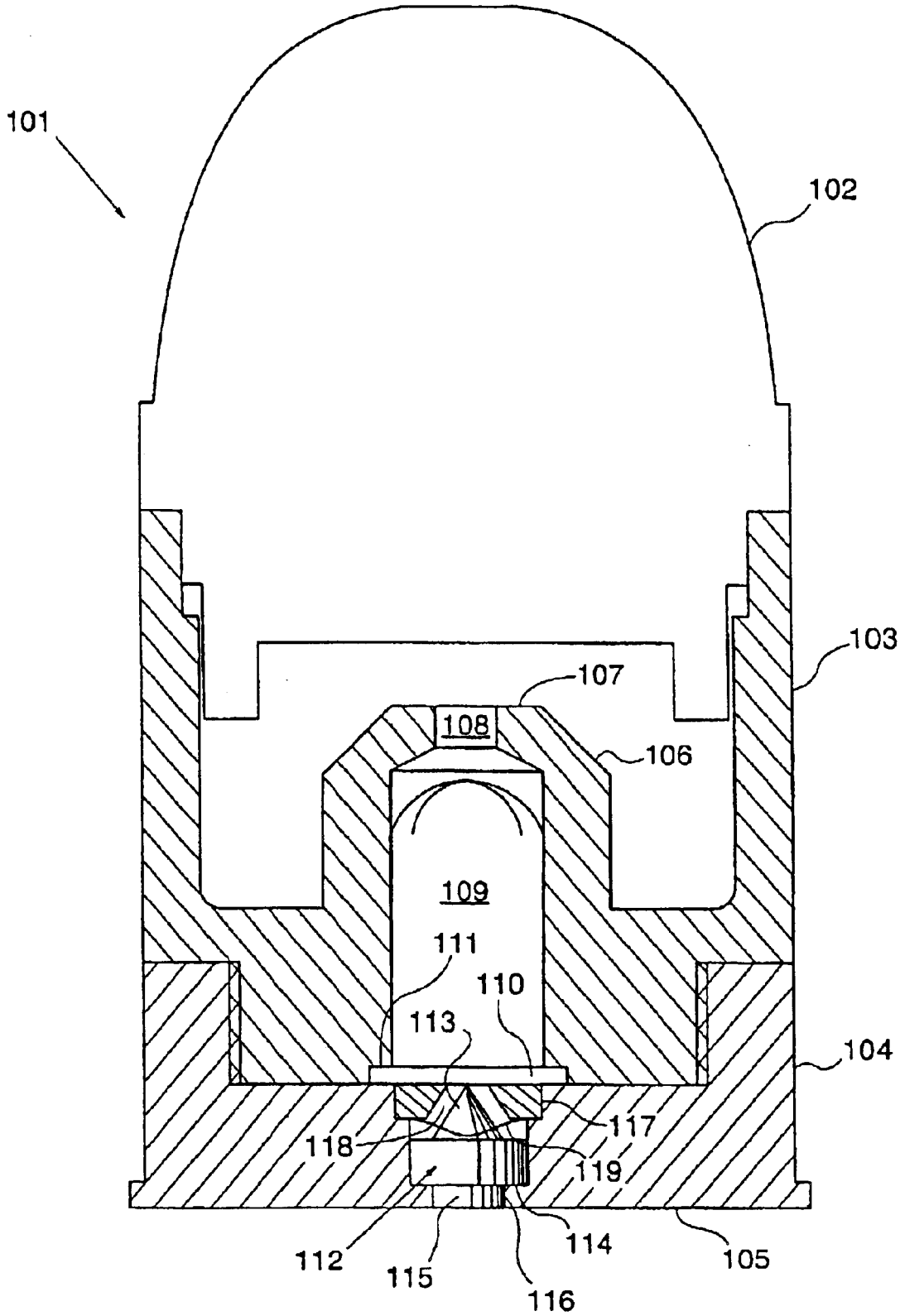

With reference to FIG. 1, a grenade cartridge 1 is diagrammatically shown in a longitudinal section through the axial center of the cartridge grenade. The elements of the grenade cartridge that are further described below are all rotationally symmetric elements, arranged about a common center line L.

The grenade cartridge 1 is adapted to be fired from a firing tube, and comprises a projectile, a cartridge and a propellant with primer. According to the invention, the cartridge is reusable and has a wall thickness sufficient to withstand the deformation forces deriving from the gas pressures that are generated upon firing the propellant of the grenade cartridge. The cartridge is rechargeable and structured to receive a separate propellant cartridge in such way, that the reactive force that is generated upon firing and directed for separating the propellant cartridge from the grenade cartridge, is fully absorbed by the grenade cartridge.

In the embodiment of FIG. 1, the grenade cartridge 1 comprises a projectile 2 received in a first, open end of a tube-shaped front portion 3 of the grenade cartridge, as seen in the firing direction. A second, rear end of said cartridge front portion 3 is detachably connected to the front end of a rear portion 4 of the grenade cartridge, said rear portion 4 forming an end plane 5 of the grenade cartridge. A high-pressure chamber 6 is arranged in the longitudinal center of the front portion 3, and axially extended to terminate in an end wall 7 in a front end thereof. Through a central opening 8 in the end wall 7, the inner volume 9 of the high-pressure chamber is connected with a low-pressure chamber 10 that is radially defined by the cylindrical wall of the cartridge front portion 3. The low-pressure chamber 10 is defined longitudinally by the end plane 11 of the projectile, and by a rear wall 12 of said cartridge front portion 3. A gap 13 is produced between the projectile end plane 11 and the opening 8 of the high-pressure chamber in order to secure the desired effect of the high-/low pressure system.

A propellant cartridge 14 is received to be seated in the high-pressure chamber 6 in surface contact with the cylindrical inner wall surface 15 of the high-pressure chamber. The propellant cartridge 14 has a propellant charge 16, e.g. a powder charge, and a primer 17 by which the powder charge is ignited when the grenade cartridge is fired through the action of a firing pin in a firing mechanism (not shown). The propellant charge and the primer are conventionally supported in a metal sleeve 18, the opening front end of which may be closed to have the dome-shape as is shown in FIG. 1.

According to the invention there is suggested a propellant cartridge 14 in which a rearmost portion is radially undercut to comprise a shoulder 19. The undercut portion has a longitudinal length that corresponds to the wall thickness of the end plane 5 of the rear cartridge portion 4. When the propellant cartridge is received in the cartridge chamber, the primer 17 levels with the end plane 5 and to which purpose the end plane is formed with a central opening 20. In the mounted position, the shoulder 19 abuts an inner surface of the end plane 5.

In the mounted position, the propellant cartridge 14 is also supported by its front, dome-shaped end abutting the inner surface of high-pressure chamber wall 15. To this end, the chamber wall 15 has a tapering radius 21 towards the opening 8. The inner radius of the high-pressure chamber wall preferably has a stepwise reduction, as seen in the drawing, in order to provide a shoulder that supports the front end of the propellant cartridge. In the mounted position, the propellant cartridge 14 is thus longitudinally supported from both the cartridge front portion 3 and the cartridge rear portion 4, when the grenade cartridge 1 is assembled.

As suggested by the present invention, the cartridge portions 3 and 4 are detachably connected in the assembled mode. Preferably, the connection 22 is performed by a thread formed on the outside of the front portion 3, engaging an inner thread formed on the rear portion 4.

As stated above, the cartridge front portion 3 has a wall or end portion 12 from the center of which the high-pressure chamber 6 extends longitudinally into the front portion 3. The high-pressure chamber 6 may be integrally formed with the front portion 3. Alternatively, the high-pressure chamber 6 may be a separate element that is attached to the end portion 12, as shown by the embodiment of FIG. 1, through frictional engagement, threaded engagement or by any other suitable means. The end rim of the front portion 3 has a radially undercut formation 23 that is externally formed to have coupling means mating with the cartridge rear portion 4 in the assembled mode.

The cartridge rear portion 4 comprises the end plane 5, having a cylindrical wall 24 forwardly extended from a peripheral area of the end plane. A radially protruding flange as known per se, or other similar formation may be arranged on the end plane in order to support the grenade cartridge when inserted in the firing tube, and in order to facilitate the extraction of the grenade cartridge after firing. The inner surface of the cylinder wall 24 is formed with coupling means for engagement with mating coupling means that are formed on the undercut portion 23 of the cartridge front portion 3, and adapted to detachably hold the cartridge portions in the assembled position. Preferably, the connection 22 is a threaded engagement, but may also include a bayonet type connection, e.g.

The projectile 2 may be a solid and homogenous body. The projectile 2 shown in the drawing is combined through an outer and front ballistic body 2, having a ballast body 2' received therein. The outer body 2 carries a surrounding drive band 25 for engagement with the internal beams of the rifle bore, such that the projectile upon acceleration is given a rotation about its longitudinal axis for stabilizing the flight. In order to reduce friction, the drive band and preferably also the outer body itself is produced from a relatively soft material such as soft metal or synthetics.

In the shown embodiment, the ballast body 2' is produced from metal in order to imitate the total weight and weight distribution of the explosive grenade. The two bodies are rotationally secured at least to the extent that the ballast body is brought in the rotation that is forced into the outer body, when this is accelerated through the firing tube.

For this purpose, the outer surface of the ballast body may be formed for engagement with the outer body by having longitudinal ribs, threads or other suitable formations (not shown).

In a first end of the cartridge front portion 3, as seen in the firing direction, measures are taken to hold the projectile 2 with a certain resistance against expulsion. In the shown embodiment this is achieved by forming the projectile to be frictionally received in a groove 26, formed internally on the cylinder wall 27 of the cartridge front portion. As an alternative, the engagement between the cartridge front portion and the projectile is arranged such that the contact area of the projectile is deformed upon firing. This solution may incorporate an internal thread (see FIG. 5) formed in the surface of groove 26 and protruding into the projectile material when this is inserted in the cartridge front portion 3 by screwing. Other alternatives may incorporate a radially inwards protruding flange or bulge, that is received in a groove surrounding an insert portion of the projectile when the projectile is mounted in position. Without being specifically shown in the drawings it should be mentioned, that also the propellant cartridge alternatively may have a threaded engagement with the grenade cartridge.

In the shown embodiment, the projectile 2 has a flat nose. Alternative embodiments of the projectile body may include a round nose, ogival shape or torpedo shape, e.g., or any other shape suitable for the intended purpose.

An important feature in this invention is, that the grenade cartridge 1 is rechargeable. When the grenade cartridge is fired, the cartridge portions 3, 4 are separated by opening the connection 22 to remove the empty metal case of the propellant cartridge, that is made accessible. A new propellant cartridge is inserted into the high-pressure chamber 6, and the cartridge portions 3, 4 are connected whereby the propellant cartridge is axially supported in opposite directions from the two connected cartridge portions. A new projectile 2 is then inserted in the groove 26 formed in the cartridge front portion 3, whereby the grenade cartridge 1 is made ready for the next firing.

An alternative embodiment 101 of the reusable grenade cartridge is shown in FIG. 2. This embodiment comprises a projectile body 102, a two-part cartridge having a first, front portion 103 in the firing direction and a second, rear portion 104 formed with an end plane 105. A high-pressure chamber 106 is integrally formed with the cartridge portion 103, and protrudes forwardly from the center of an end portion of the cartridge front portion 103. The high-pressure chamber 106 has a front end 107 with a central opening 108. The high-pressure chamber 106 has an open rear end wherein a propellant cartridge 109 is received in surface contact with the inside of the cylindrical wall of the high-pressure chamber. The propellant cartridge has a flange 110 received in a recess 111, said recess being formed in the end surface of the cartridge front portion, concentric relative to the high-pressure chamber. As such, the high-pressure chamber forms a cartridge chamber for the propellant cartridge.

The end plane 105 of the cartridge rear portion 104 has a longitudinal length sufficient for accommodating a firing pin 112 in the center thereof. The firing pin 112 has a point 113, a radially protruding flange 114 and a guide portion 115 having a smaller diameter. The firing pin 112 is axially moving in a through hole 116 that is formed in the end plane 105, and the guide portion 115 is received in a rear, narrow portion of the through hole. A nut 117 is screwed into the through hole 116 in order to hold the firing pin in the hole. The nut 117 preferably has a tapering hole 118, diverging towards the firing pin end of the nut and dimensioned to provide an operative stroke length of the firing pin to hit the primer of the propellant cartridge (not shown). A spring member 119, such as a cup-spring, is arranged between the nut 117 and the flange 114 and operative for urging the firing pin towards the rest position shown in FIG. 2.

The grenade cartridge 101 is rechargeable substantially in the same manner as the grenade cartridge 1. After firing, the cartridge portions are separated such that the empty metal case of the propellant cartridge is accessible for removal. A new propellant cartridge is installed in the high-pressure chamber 106 and the cartridge portions are assembled so that the propellant cartridge is axially supported in both directions form the two cartridge portions. A new projectile 102 is inserted into the cartridge front portion 103, and the grenade cartridge 101 is ready for the next firing.

It will be understood that the cylinder wall of the cartridge front portion should have sufficient radial thickness to withstand the gas pressure that is generated upon firing, without being deformed. Advantageously, the cartridge is produced from steel or steel alloy, but also other metals or composite materials may be conceivable for producing the reusable and rechargeable grenade cartridge. Through an over-dimensioned material thickness, compared to the conventional disposable cartridge, a reusable cartridge is provided for repeated firing of projectiles with a realistic performance.

The connection between high-pressure chamber 6, 106 and the low-pressure chamber, that is the opening 8, 108, also serves for ejection of the empty case of the propellant when the grenade cartridge is recharged. It will be understood that the opening diameter, the drive resistance of the projectile, the charge size and burning velocity should be considered in order to achieve the proper velocity of the projectile, in order to imitate the properties of an explosive grenade, e.g., in a training ammunition. It would be in reach for a man skilled in this art to find the best charging specification by which the muzzle velocity of the projectile may be set and adapted for a specified application.

Modification of details is possible without departing from the solution that is suggested herein, and being described with reference to the above examples. The common principal of the two previous embodiments is that the separate propellant cartridge is supported in such way, that the reactive force that is generated upon firing will be absorbed by the grenade cartridge. This is achieved by axially supporting the propellant cartridge in the end plane, which is made possible through the provision of a dividable grenade cartridge. When assembled, the two-part cartridge axially supports the separate propellant cartridge in both axial directions. Through these measures, deformation forces are prevented from acting between the cartridge and a firing tube, thus making possible the repeated firing with the rechargeable grenade cartridge.

Figures 3A, 3B:
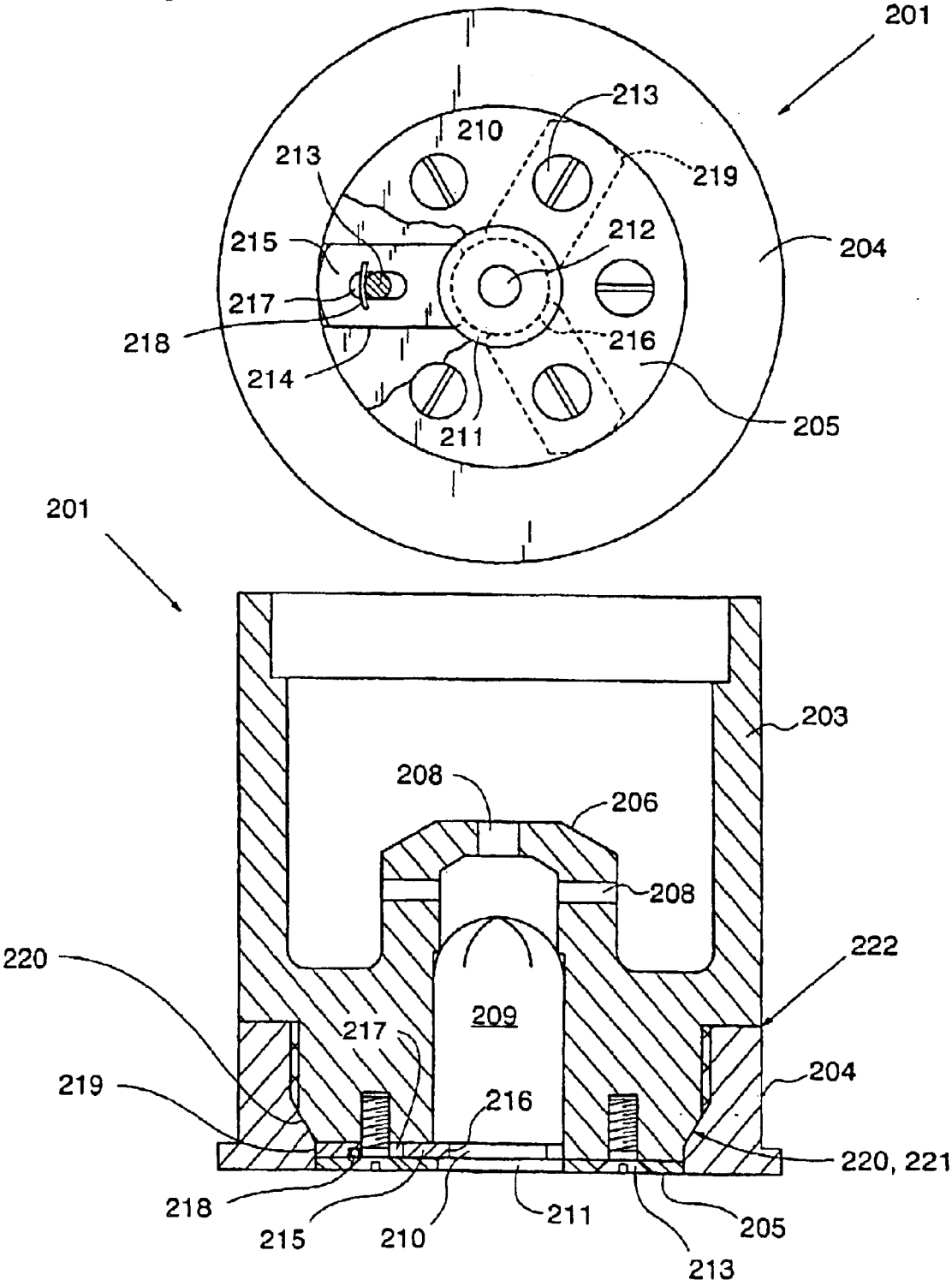
FIG. 3*a* is a longitudinal section showing yet another embodiment.
FIG. 3*b* is a partial end view showing the embodiment of FIG. 3*a*, and FIGS. 4, 5, 6, 7 and 8 are further alternative embodiments showing the invention.

With reference now to FIGS. 3*a* and 3*b*, yet another embodiment of the grenade cartridge will be described.

The grenade cartridge 201 is dividable, comprising a cartridge front portion 203 and a cartridge rear portion 204. The rear portion 204 is ring shaped, and the front portion extends with an end plane 205 through the ring when the rear and front portions are assembled as is shown in the drawings. A high-pressure chamber 206 is axially extended in the center of the cartridge front portion 203, and comprises through holes 208 through which the propulsion gases flow from the high-pressure chamber upon firing. The high-pressure chamber 206 is formed as a cartridge chamber for a propellant cartridge 209, in this case provided with an ejection groove 210 that is axially located behind a flange 211. A primer 212 (see FIG. 3*b*) is conventionally mounted in the propellant cartridge.

The end plane 205 is a ring shaped plate 205, attached to an end surface of the cartridge front portion 203 through bolts 213. In the end plate, recesses 214 are formed for sliding accommodation of radially moving heels 215. The radially inner end 216 of each heel is formed for engagement with the ejection groove 210 of the propellant cartridge. A guide slot 217 is arranged on each heel, the guide slot having a width related to the width of a non-threaded neck portion of the bolts 213. A spring member 218 is arranged in the guide slot 217 in such way, that the heel is biased outwardly in the radial direction. The radially outer end 219 of the heel is bow shaped, preferably having a radius that is less than the outer radius of the end plate 205. Conical surfaces 220, 221 are formed in the contact area between the two cartridge portions 203, 204, in combination with a threaded connection 222.

When recharging the grenade cartridge 201, a new propellant cartridge is inserted in the high-pressure chamber 206. The high-pressure chamber is internally formed with a decreasing radius in order to define a stop for the propellant cartridge and for holding the front end of that cartridge, as stated above. In this step, the heels are urged radially outwards by the spring member, acting between the heel and the screw 213. When tightening the cartridge front portion 203 to the ring 204, the heels 215 slide against the conical surface 220 and are successively urged to engage the ejection groove 210 of the propellant cartridge, against the force of the spring member 218. The conical surfaces 220, 221 may advantageously have a slope angle that changes over the periphery such that the surfaces are slightly helical, whereby the heels will be brought to engage the ejection groove one by one. Further, the inner and arcuate ends of the heels may be chamfered in order to facilitate the engagement with the ejection groove of the propellant cartridge Likewise, the outer arcuate ends of the heels may be chamfered or rounded in order to facilitate the sliding motion over the conical surface 220.

Also in this embodiment, the two-part grenade cartridge axially supports the propellant cartridge in both directions such that reactive forces that are generated upon firing and would act between the propellant cartridge and the grenade cartridge, will be fully absorbed by the grenade cartridge. This ensures the prevention of the propellant cartridge being separated from the grenade cartridge, an effect that would cause damages to the firing tube, especially on a light metal firing tube.

Modifications of this embodiment are conceivable without departing from the principles of this solution. Such modification may include the provision of any other number of heels than the three heels described, to be radially sliding in the end plane of the cartridge. Further, the heels may be guided in dovetail slots or otherwise received in the rear end surface of the cartridge front portion, in which case the annular end plate 205 may be omitted.

FIG. 4 shows a partially sectioned portion of a grenade cartridge substantially as described above with reference to FIGS. 3*a* and 3*b*. A heel 215' is received in a dovetail slot 223 and radially sliding therein to engage the ejection groove 210 of the propellant cartridge. A spring member 218' is received in a bore arranged on the dovetail of the heel, the spring member resting with its radially inner end against a cylinder sleeve 224 that is inserted in the cartridge front portion.

FIG. 5 shows yet another embodiment of the grenade cartridge of the invention. In this embodiment, the high-pressure chamber is removed and the propellant gases expand directly against the projectile body. The projectile that is made of softer metal or synthetic material is in threaded engagement with the cartridge front portion. The threaded engagement 225 is dimensioned in aspects of depth of engagement, pitch of thread and number of threads in order to ensure, that a certain pressure is generated behind the projectile, before the thread of the projectile is deformed and the projectile is forced out from the cartridge.

FIG. 6 shows yet another embodiment of the grenade cartridge of the invention. The difference from the embodiment of FIG. 1 is that the projectile 2" has a smaller caliber (diagrammatically shown) than the grenade cartridge, and adapted to be forced through a bore 26' that is formed in the cartridge front portion. The projectile bore 26' is formed as a blind hole, the inner end of the hole being defined by a front wall of a high-pressure chamber.

FIG. 7 shows a further embodiment of the grenade cartridge of the invention. The grenade cartridge 301 has a cartridge front portion 302 and a cartridge rear portion 303, coupled through a thread connection (not shown in detail). A projectile bore 304 reaches through the cartridge front portion, the rear end of the bore being formed to receive a projectile body 305. Alternatively, the bore 304 is rifled as shown in the drawing, but may also be smooth-bored if more suitable. The projectile 305 is inserted in a propellant cartridge 306, carrying a propellant charge 307 and a primer 308. The propellant cartridge 306 has a radially undercut portion that projects in a hole that is formed through the center of the cartridge rear portion 303. Longitudinally behind the undercut portion, the propellant cartridge has a protruding flange 309, resting on an annular recess 310 that is formed in the rear end surface of the cartridge front portion 302 when the propellant cartridge is received in the cartridge front portion. For a better understanding, the projectile body 305 and bore 304 are shown in the drawing to have substantially smaller diameters relative to the firing tube, from which the grenade cartridge 301 is fired. The relative diameters of the bore and firing tube is not decisive for the inventive solution, as the projectile in this case is guided solely by the bore 304 when fired.

Also in this embodiment, the propellant cartridge is axially supported in both directions when the cartridge front and rear portions are assembled so that reactive forces that are generated upon firing will be absorbed by the grenade cartridge. A difference from the other embodiments is, that the propellant cartridge and the projectile are integrally inserted as a unit in the grenade cartridge upon recharge.

Figure 8:
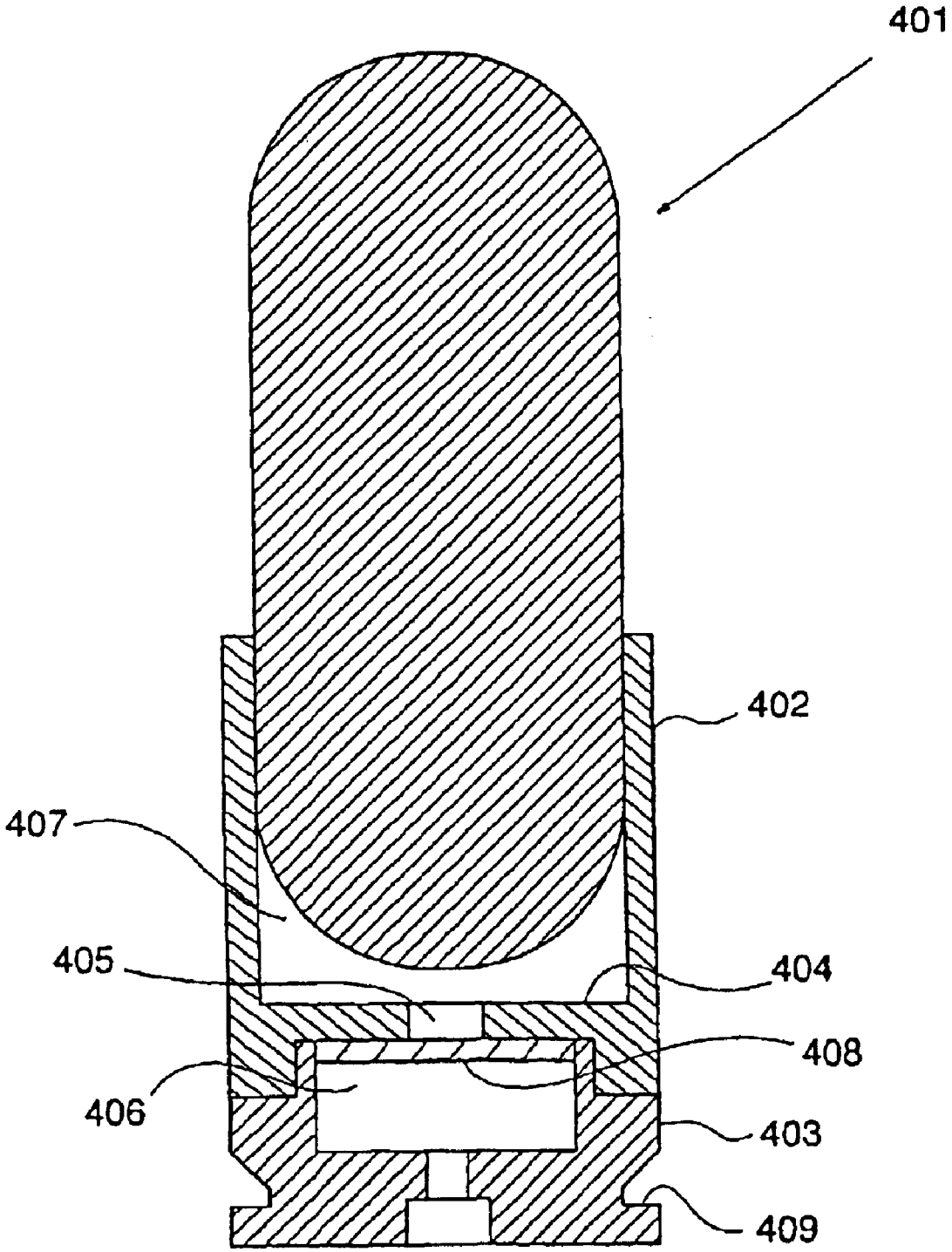

With reference made to FIG. 8 there is shown still another embodiment of the grenade cartridge of the invention. The grenade cartridge 401 has a two-part cartridge wherein a cartridge front portion 402 is formed to receive a projectile, and a cartridge rear portion 403 is formed to be connected with the front portion of the cartridge. Said cartridge front portion 402 has a transverse partition wall 404 with one or several through holes 405, the through holes connecting a high-pressure chamber 406 with a low-pressure chamber

407 in front thereof. The cartridge rear portion 403 is formed to carry a propellant charge that may be integrated in the cartridge rear portion, or comprise a separate propellant cartridge (not shown in detail). In front of the propellant charge, a membrane 408 is advantageously arranged and dimensioned for protecting the propellant charge. The cartridge rear portion 403 is formed with an ejection groove 409 in order to permit automated reload of the grenade cartridge 401. The cartridge rear portion 403 may be disposable and replaced as a unit, and may alternatively be reusable by insertion of a new propellant charge.

In this invention as defined by the enclosed generic claim, there is provided a grenade cartridge which is characterized in being reusable through a dividable, two-part cartridge arranged so that a propellant cartridge is axially supported in a way, that reactive forces are absorbed by the grenade cartridge. Advantageous embodiments are described above and defined in the subclaims. The grenade cartridge of the invention is intended primarily, but not exclusively, for shooting practice. However, also explosive projectiles of different types and purposes may be fired from the disclosed grenade cartridge.

What is claimed is:

1. A reusable grenade cartridge for firing projectiles from a firing tube, comprising:

a cartridge front portion adapted to hold a projectile, said cartridge front portion being detachably connectable to a cartridge rear portion;

said cartridge rear portion having an end plane with a wall thickness, a central through hole and an inner wall surface, adapted for supporting a propellant cartridge axially in a direction opposite to a firing direction;

a high pressure chamber, opening into a low pressure chamber that is formed in the cartridge front portion, said high pressure chamber being arranged to receive said propellant cartridge and to support said propellant cartridge axially in the firing direction; and a propellant cartridge carrying a propellant charge and a primer, said propellant cartridge being formed in the rear end with a radially undercut portion providing a shoulder, said shoulder abutting said inner surface of the end wall and said primer leveling with said end plane of the rear cartridge portion when said undercut portion is received through said central hole, the propellant cartridge being replaceable through separation of the cartridge front portion from the cartridge rear portion.

2. The cartridge of claim 1, wherein the high pressure chamber has an inner wall, the radius of which inner wall is reducing towards the opening into the low pressure chamber of the cartridge front portion.

3. The cartridge of claim 2, wherein the inner wall of the high pressure chamber is formed with a stepwise reducing radius.

4. The cartridge of claim 1, wherein the cartridge front portion is detachably connected to the cartridge rear portion through a threaded engagement.

5. The cartridge of claim 1, wherein the high pressure chamber is formed integrally with the cartridge front portion.

6. The cartridge of claim 1, wherein the high pressure chamber is separately attached to the cartridge front portion.

7. The cartridge of claim 1, wherein a cylinder wall of the cartridge front portion is formed to hold a projectile, said cylinder wall being formed internally for deformation of a contact area of the projectile upon firing.

8. The cartridge of claim 7, wherein the cylinder wall of the cartridge front portion is internally formed for a threaded engagement with the projectile.

* * * * *